US010294017B2

(12) United States Patent
Farid et al.

(10) Patent No.: US 10,294,017 B2
(45) Date of Patent: May 21, 2019

(54) GIFT PACKAGE FOR SHARABLE APPLE BOX

(71) Applicant: Edible Arrangements, LLC, Wallingford, CT (US)

(72) Inventors: Tariq Farid, Wallingford, CT (US); Olivia Dupin, Wallingford, CT (US); Asad Hamid, Wallingford, CT (US); Xavier Lederer, Wallingford, CT (US); Simon Gainey, Media, PA (US); Jessica Keene, Philadelphia, PA (US); Vicki Catalina, Chelsea, MI (US)

(73) Assignee: EDIBLE ARRANGEMENTS, LLC, Wallingford, CT (US)

( * ) Notice: Subject to any disclaimer, the term of this patent is extended or adjusted under 35 U.S.C. 154(b) by 182 days.

(21) Appl. No.: 15/239,001

(22) Filed: Aug. 17, 2016

(65) Prior Publication Data

US 2017/0050797 A1 Feb. 23, 2017

Related U.S. Application Data

(60) Provisional application No. 62/206,629, filed on Aug. 18, 2015.

(51) Int. Cl.
*B65D 77/04* (2006.01)
*B65D 81/26* (2006.01)
(Continued)

(52) U.S. Cl.
CPC ..... *B65D 85/34* (2013.01); *B65D 77/0413* (2013.01); *B65D 81/264* (2013.01); *B65D 85/60* (2013.01)

(58) Field of Classification Search
CPC .. B65D 85/34; B65D 77/0413; B65D 81/264; B65D 85/60; B65D 81/133; B65D 11/188; A23L 19/08
See application file for complete search history.

(56) References Cited

U.S. PATENT DOCUMENTS

D5,030 S 6/1871 Ketcham
1,646,347 A 10/1927 Collette
(Continued)

FOREIGN PATENT DOCUMENTS

DE 9305109 U1 * 7/1993 ..... B65D 81/025
EP 1627827 A2 * 2/2006 ..... B65D 81/025
(Continued)

OTHER PUBLICATIONS

"Nexus Q" Feb. 4, 2013 http://www.thedieline.com/blog/2013/2/4/nexus-q.html (Year: 2013).*
(Continued)

*Primary Examiner* — Viren A Thakur
(74) *Attorney, Agent, or Firm* — Troutman Sanders, LLP; Christopher C. Close, Jr.

(57) ABSTRACT

The present invention is directed to packaging for fresh cut and dipped or enrobed fruit. The package comprises an outer sleeve and an encapsulating set-up carton board box; the inner compartment comprises internal inserts that secure a molded top and bottom piece that are specifically designed to hold cut pieces of fruit in a ball or "apple" formation (or that hold other fruit parts in different formations). The package was designed to protect, present, and display the fresh cut fruit product "plate-like," "bowl-like," or easily sharable form to allow it to be eaten direct from the package while maintaining a premium look and feel.

14 Claims, 7 Drawing Sheets

(51) Int. Cl.
*B65D 85/34* (2006.01)
*B65D 85/60* (2006.01)

(56) References Cited

U.S. PATENT DOCUMENTS 2,134,908 A * 11/1938 Copeman ..... B65D 85/32 206/521.6
2,244,503 A 6/1941 Riddell
2,302,639 A * 11/1942 Moore ..... A23L 3/364 217/3 R
3,365,308 A * 1/1968 Janicke ..... B65D 11/02 206/447
D216,003 S 11/1969 Smith
3,703,088 A * 11/1972 Moorhead ..... A47G 19/26 62/257
4,606,460 A * 8/1986 Luray ..... B65D 81/07 206/583
4,757,899 A * 7/1988 Magnussen, Jr. ..... B65D 85/34 206/493
4,770,293 A * 9/1988 Craig ..... B65B 11/52 206/471
D299,992 S 2/1989 Michel
4,869,387 A * 9/1989 Persson ..... B65D 81/18 206/204
D305,616 S * 1/1990 Johnson ..... D9/426
4,974,844 A 12/1990 Richards
D325,492 S 4/1992 Fabricius
5,405,009 A * 4/1995 Hackenbracht ..... B65D 43/162 206/470
D365,729 S 1/1996 Wold
5,566,953 A 10/1996 Arriola et al.
D379,389 S 5/1997 Shih
5,653,345 A * 8/1997 Knoss ..... B65D 11/188 206/470
D387,537 S 12/1997 Fosher
D393,672 S 4/1998 Clay
6,042,856 A * 3/2000 Sagan ..... B65D 1/36 206/465
D429,056 S 8/2000 Aftoora
D429,510 S 8/2000 Sullivan
D502,971 S 3/2005 Walsh
D509,624 S 9/2005 Villani et al.
D511,800 S 11/2005 Nishihara
D528,866 S 9/2006 Laib et al.
D530,744 S 10/2006 Harrison et al.
D547,197 S 7/2007 Hermel
D579,712 S 11/2008 Simon et al.
D604,110 S * 11/2009 Braidotti ..... D7/628
D605,502 S 12/2009 Honda et al.
D616,742 S 6/2010 Lymn et al.
D621,704 S 8/2010 Lymn et al.
D635,056 S 3/2011 De Nysschen
D651,074 S 12/2011 Lacey
D651,864 S * 1/2012 Bennett ..... D7/628
D662,140 S 6/2012 Huang
D663,118 S 7/2012 Zalewski et al.
D674,691 S 1/2013 Martineck
D681,310 S 5/2013 Rassi et al.
D682,675 S 5/2013 Rapparini
D685,631 S 7/2013 Rapparini
D698,567 S 2/2014 Chen
D709,652 S 7/2014 Teller
D710,940 S 8/2014 Kuehn et al.
D717,521 S 11/2014 Slusarczyk et al.
8,955,928 B2 2/2015 Cheng
D729,059 S 5/2015 Taylor
D734,550 S 7/2015 Schlatter
D735,280 S 7/2015 O'Malley
D741,593 S 10/2015 Brown et al.
D754,267 S 4/2016 Ross
D763,603 S 8/2016 Bartelmuss
D780,488 S 3/2017 Celano
D786,062 S 5/2017 Ogdon et al.
D791,587 S 7/2017 Buck
D795,058 S 8/2017 Buck
D795,059 S 8/2017 Buck
D795,688 S 8/2017 Buck
D796,317 S 9/2017 Buck
D807,167 S 1/2018 Joergensen et al.
D821,194 S 6/2018 Van Wingerden
2004/0112368 A1* 6/2004 Amico ..... A47J 41/0044 126/273.5
2005/0161455 A1* 7/2005 Studee ..... B65D 43/0281 220/266
2005/0284171 A1* 12/2005 Harl ..... A47J 41/0044 62/457.2
2007/0039838 A1* 2/2007 Bagley ..... B65D 1/34 206/204
2009/0114552 A1* 5/2009 Hall ..... B65D 81/262 206/204
2009/0136630 A1* 5/2009 Thiery ..... B65B 25/067 426/124
2011/0024324 A1* 2/2011 Tanner ..... B65D 81/075 206/588
2011/0180550 A1* 7/2011 Kenneally ..... F25D 3/125 220/592.2
2013/0082050 A1* 4/2013 Wiebold ..... B65D 85/60 220/4.24
2016/0137397 A1* 5/2016 Arnett ..... B65D 85/34 206/223
2017/0203904 A1* 7/2017 Cibert ..... B65D 81/113

FOREIGN PATENT DOCUMENTS

JP 08133369 A * 5/1996
WO WO-2008026943 A1 * 3/2008 ..... B65D 1/36

OTHER PUBLICATIONS

"Cook's Book" Nov. 3, 2013 http://web.archive.org/web/20130606110927/http://www.cooksbookblog.com/2012/11/chocolate-covered-apples-to-ease-pain.html (Year: 2013).*
"Chocolate Covered Apple Slices—One World Cafe" Jul. 17, 2014. http://www.1worldcafe.com/?p=5164 (Year: 2014).*
"USDA—Mail Order Food Safety" Oct. 14, 2013 http://web.archive.org/web/20131014221742/http://www.fsis.usda.gov/wps/portal/fsis/topics/food-safety-education/get-answers/food-safety-fact-sheets/safe-food-handling/mail-order-food-safety/ct_index (Year: 2013).*
"Forbidden Fruit NYC" 2013 http://web.archive.org/web/20130901152813/http://forbiddenfruitnyc.com/products.html (Year: 2013).*
"Tastee" Dec. 9, 2014 http://tasteeapple.com/uploads/How%20to%20Store%20a%20Caramel%20Apple-12-9-14-Final.pdf (Year: 2014).*
"Karen in the Kitchen" Oct. 6, 2010 https://kareninthekitchen.wordpress.com/2010/10/06/chocolate-dipped-strawberries/ (Year: 2010).*
The Elite Gourmet Shareable (Trademark) Gift Set. [online] Published date unknown. Retrieved on Jul. 11, 2017 from <URL: https://www.ediblearrangements.com/fruit-gifts/The-Elite-Gourmet-Shareable-Gift-Set-4004>.
Stirling, Nicholas. Juggling Ball, "Random Thoughts." Exercising Monsters. Dec. 4, 2012. Web. Jan. 21, 2016. <https://exercisingmonsters.wordpress.com/2012/12/04/random-thoughts/>.
Marusenko, Aleksandr. "3D Puzzle Marusenko Sphere Made with 3D Printer." www.3ders.org. Jul. 15, 2013. Web. Dec. 29, 2015. <http://www.3ders.org/articles/20130715-rapid-prototyping-for-the-genuine-3d-puzzle-marusenko-sphere.html>.
"Yogurt Scones Recipe. Chocolate & Zucchini." Mar. 10, 2015. Web. Jul. 7, 2017. <http://chocolateandzucchini.com/recipes/bread-brioche/yogurt-scones-recipe/>.
"The Chocolate Apple!." Confabulous. Sep. 2, 2016. Web. Jul. 7, 2017. <https://karenjamesbarclay.wordpress.com/2016/09/02/the-chocolate-lemon/>.
"Spheres 3D Diagrams for PowerPoint." Showeet. Dec. 16, 2012. Web. Jul. 7, 2017. <http://www.showeet.com/16/12/2012/charts-and-diagrams/spheres-3d-diagrams-for-powerpoint/>.

(56) References Cited

OTHER PUBLICATIONS

"Royalty Free Stock Photography: 3D Exploded Graph Pie." Dreamstime. Sep. 20, 2013. Web. Jul. 7, 2017. <https://www.dreamstime.com/royalty-free-stock-photography-3d-exploded-graph-pie-image20470867>.

"Beachball Skewb." Jaap's Puzzle Page. May 11, 2009. Web. Dec. 29, 2015. <http://www.jaapsch.net/puzzles/beachbll.htm>.

"3D Segmented Sphere Four Quadrants Slide Design." Slide Model. Oct. 15, 2014. Web. Dec. 29, 2015. <http://slidemodel.com/templates/3d-segmented-spheres-diagram-template-powerpoint/3d-segmented-sphere-four-quadrants-slide-design/>.

Plastic Single serve Container, brand not listed, published at skiptomylou.org, posed by blogger Cindy on May 1, 2014, copyright 2018 Skip to my Lou, online, available from the internet, URL:https:/www.skiptomylou.org/you-take-the-cake-teacher-gift-idea-2/ (Year: 2014).

Deluxe Bundt Cake Keeper, Nordic Ware, kitchenandcompany.com, author not listed, posed on Jan. 20, 2015, copyright 2018 Calvert Retail, L.P., online, available from internet, URL:http://www.kitchenandcompany.com/Storage-And-Cleaning/Food-Storage/Canisters-And-Dry-Food-Storage . . . (Year: 2015).

* cited by examiner

GIFT PACKAGE FOR SHARABLE APPLE BOX

CROSS REFERENCE TO RELATED APPLICATION

This application claims priority to U.S. Provisional Patent Application No. 62/206,629, filed on Aug. 18, 2015 and entitled "GIFT PACKAGE FOR FRESH CUT FRUIT," which is hereby incorporated by reference in its entirety.

RELATED FIELD

The present invention relates to product packaging. The present invention relates to packaging system that enables the package and its components to completely support multiple functions during the making, delivery or distribution, presentation and consumption of the product in a way not seen currently. In particular, the present invention relates to product packaging for fruit and other perishable products.

BACKGROUND

Fresh cut dipped and enrobed fruits and other perishable food products are commonly gifted for everyday, holiday and special occasions to friends, family, business associates, employees, clients and customers. This type of product is readily available to purchase via the internet, in-person or phone for shipment delivered local, parcel service or purchased at store. In the past, the fruit would normally be laid out flat on a sheet (that provides organization and drainage), then in a carton.

What is needed are better systems and methods for preserving, transferring and presenting the perishable food products.

SUMMARY

Disclosed herein are method and system for product packaging, where the packaging serves as a primary protective package for the product contained within, serves as a decorative package that allows it to be presented as a gift, and also serves as a means of serving where the protected food product can be presented and eaten from within the package, all in a distinctive and stylish manner.

In one aspect, disclosed herein is a protective and decorative packaging system. The packaging system has been developed to transport and protect the product, but also elevate the gifting experience from initial viewing of outer package through to the exposure of the fruit and consumption of it by the recipient(s).

In some embodiments, the packaging system is a gift top system that comprises a box top, a box top insert, a box bottom insert, a box bottom and a box sleeve.

In some embodiments, the packaging system disclosed herein further comprises one or more internal packaging elements. In some embodiments, a thermoform lid and a thermoform tray that are received within the box top insert and box bottom insert, respectively. This internal package element provides product organization by holding it in place with two plastic molded pieces, which also controls damage in shipping, provides for drainage, and nests inside the bottom outer carton board piece.

In some embodiments, the packaging system disclosed herein further includes a cooling element. For example, the cooling element can be a cooling ring or ice pack.

The outer sleeve, top carton board and top molded piece are removed to present a distinctive table worthy serving ware unit. In one aspect, disclosed herein is a packaging system that comprises an external packaging component, an internal packaging component and an inner compartment. In some embodiments, the external packaging component comprises a top packaging element, and a bottom packaging element, where the top packaging element fits over the bottom packaging element to form an enclosed package. In some embodiments, the internal packaging component comprises a top packaging insert, and a bottom packaging insert, where the top packaging insert has a bottom opening and the bottom packaging insert has a top opening, and where the bottom opening and the top opening face each other and form a continuous space. In some embodiments, the inner compartment is securely positioned within the continuous space and comprises a top cover, and a bottom container, where the top cover and the bottom container form an enclosed compartment, where the top cover includes a first plurality of structural element and the bottom container includes a second plurality of structural elements for securely storing a plurality of food items.

In some embodiments, the first plurality of structural elements comprises inward elongated protrusions that extend vertically towards the edge of the top cover.

In some embodiments, the second plurality of structural elements comprises inward elongated protrusions that extend vertically towards the edge of the bottom container.

In some embodiments, the first plurality of structural elements comprises 6 or more structural elements.

In some embodiments, the first plurality of structural elements comprises 10 or fewer structural elements.

In some embodiments, the second plurality of structural elements comprises 6 or more structural elements.

In some embodiments, the second plurality of structural elements comprises 10 or fewer structural elements.

In some embodiments, the structural elements in the second plurality are spherical cavities.

In some embodiments, the structural elements in the second plurality are cavities that are shaped as one end of an apple wedge.

In some embodiments, the packaging system further comprises a cooling element positioned between within the top packaging insert of the internal packaging component and above the top cover of the inner compartment.

In some embodiments, the cooling element is circular in shape.

In some embodiments, the packaging system further comprises a sleeve, slideably fitting over and holding together the enclosed package formed by the top packaging element and bottom packaging element.

In some embodiments, the bottom container of the inner compartment comprises small drainage openings.

In some embodiments, the packaging system further comprises an absorbent pad placed underneath the bottom container.

In some embodiments, the packaging system further comprises a plurality of fruit items positioned within the top cover and bottom container and secured by the first and second pluralities of structural elements.

In some embodiments, the plurality of fruit items are selected from the group consisting of blueberry truffles, strawberries, orange slices, cut banana pieces, apple wedges, grapes, cut melon pieces, cut pineapple pieces, and combinations thereof.

In some embodiments, one or more the fruit items of the plurality of fruit items are covered with chocolate.

In some embodiments, the plurality of fruit items comprises 8 apple wedges covered with dark chocolate.

DETAILED DESCRIPTION

The present invention is directed to packaging for fresh cut and dipped, covered or otherwise decorated (enrobed) fruit items. The package further provides a premium gifting and eating experience.

The present invention recognizes the trend of premium gift giving and fresh cut fruit consumption for its healthy, freshly made, premium quality position. The present invention enables the package and its components to completely support multiple functions during the making, delivery or distribution, presentation and consumption of the product in a way not seen currently.

The package was designed to protect, present, and display the fresh cut fruit product "plate-like," "bowl like," or easily sharable form to allow it to be eaten direct from the package while maintaining a premium look and feel.

Figure 3:
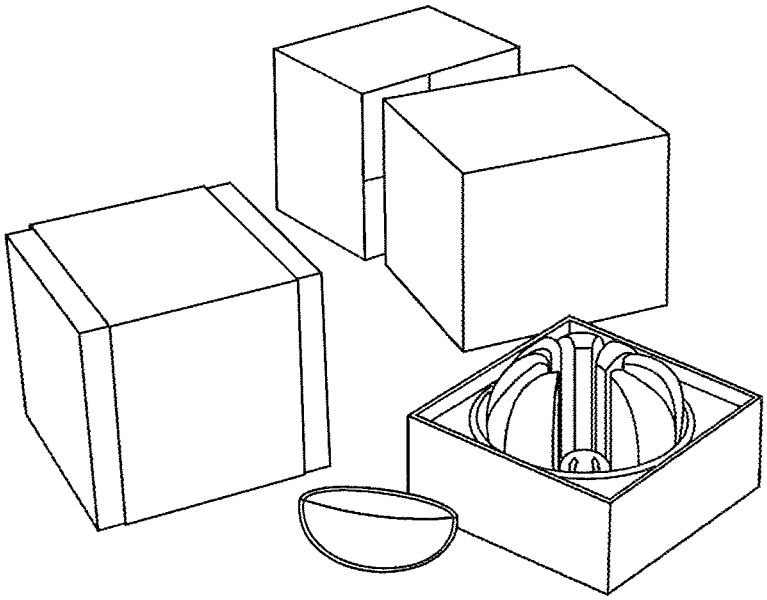
FIG. 3 shows an exemplary embodiment, depicting a closed packaged system and an opened packaging system.
Figure 4:
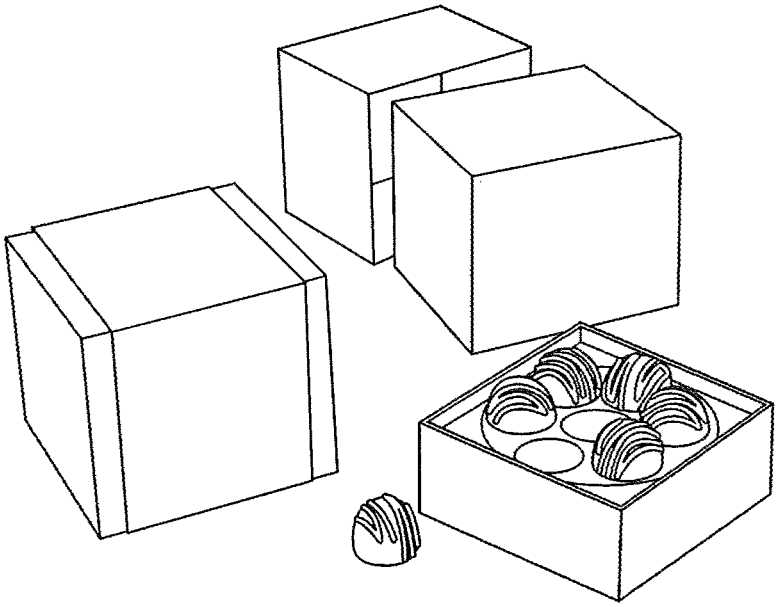
FIG. 4 shows an exemplary embodiment, depicting a closed packaged system and an opened packaging system.

In one aspect, disclosed herein is a gift packaging system, as depicted in FIGS. 1, 3 and 4. Referring to FIG. 1A, an exemplary packaging system 100 comprises an external packaging component, an internal packaging component and a sleeve 110. In some embodiments, the packaging system further comprises an inner compartment (see, e.g., element 160 in FIG. 1B).

Figure 1A:
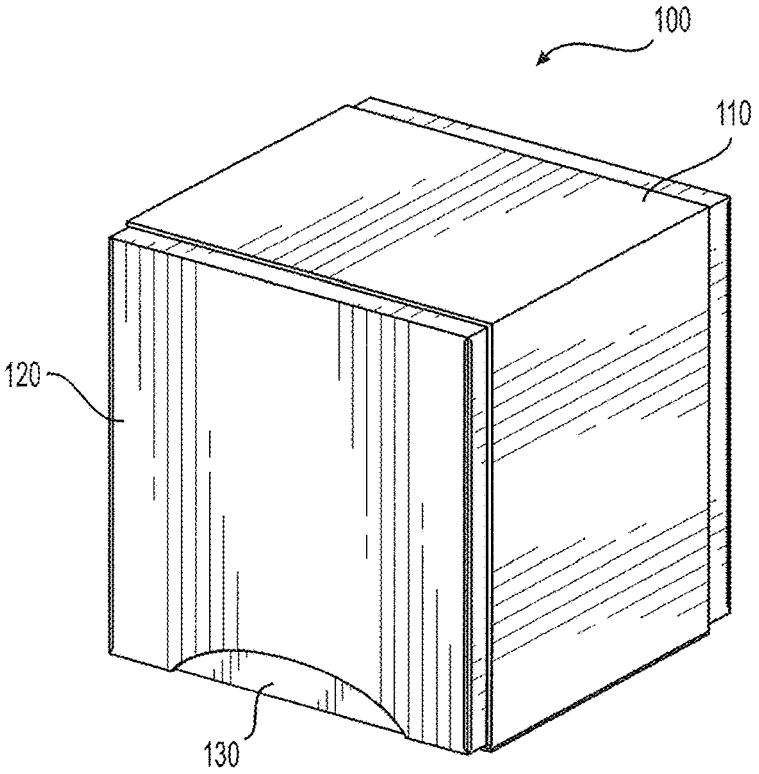
FIG. 1A shows an exemplary embodiment, depicting a packaging system with a slideable sleeve.
Figure 1B:
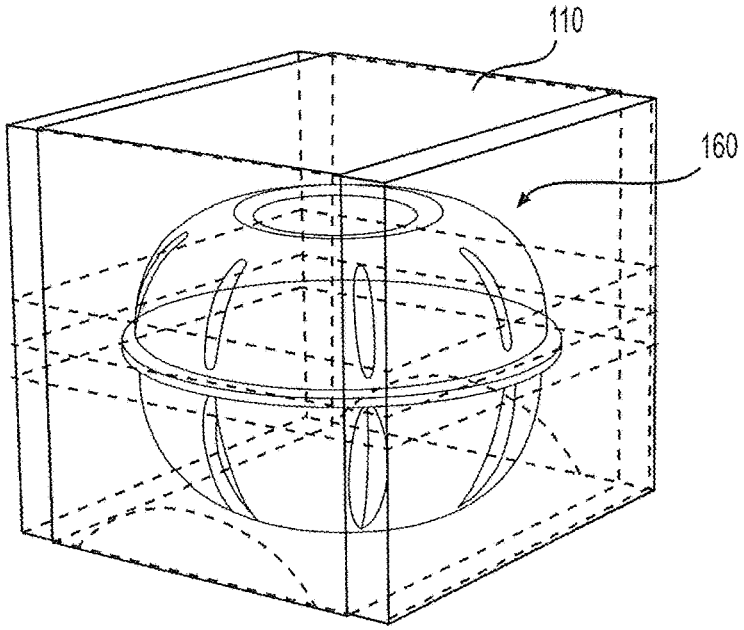
FIG. 1B shows an exemplary embodiment, depicting an inner compartment within the packaging system.
Figure 1C:
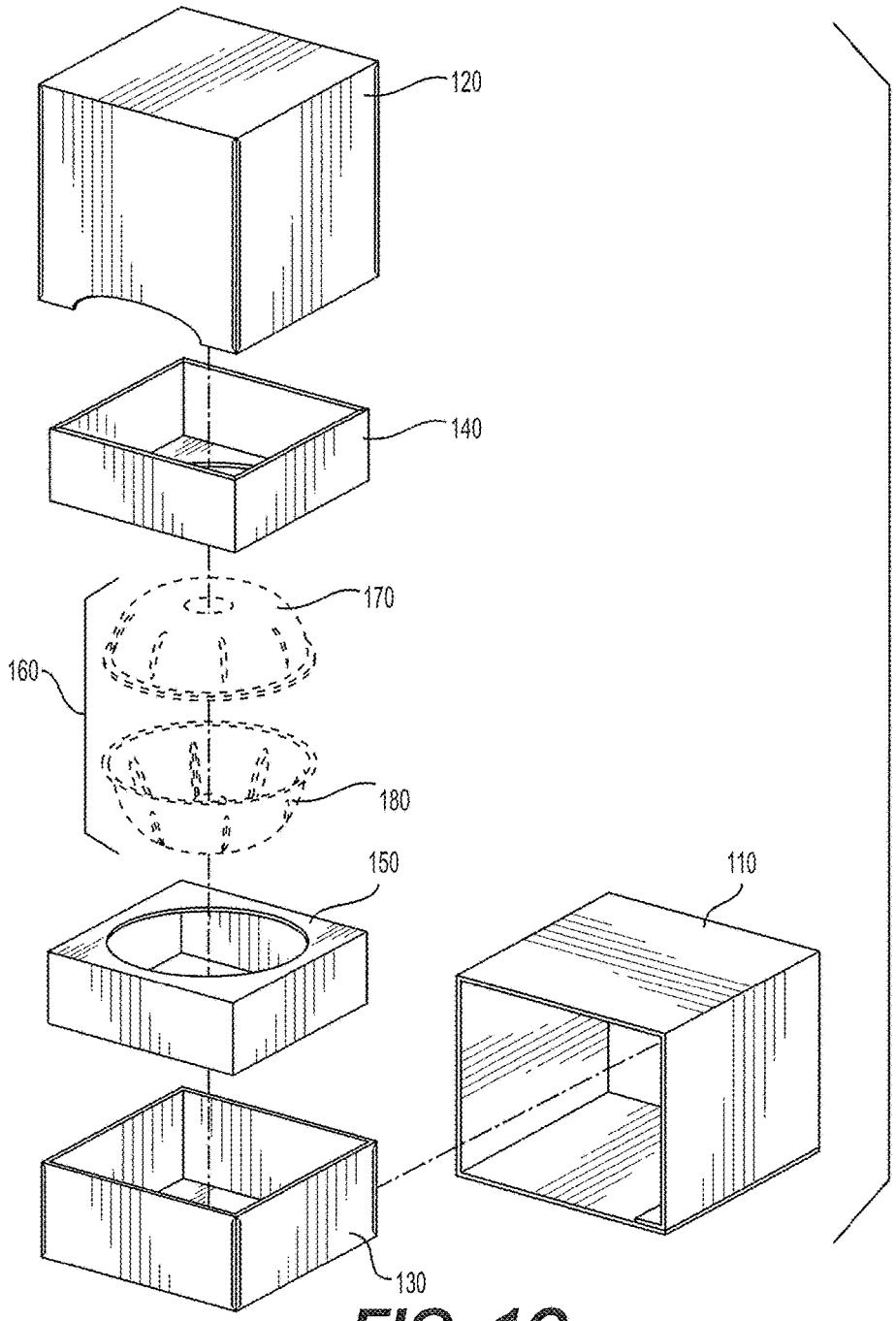
FIG. 1C shows an exemplary embodiment, depicting an exploded view of a packaging system.
Figure 1D:
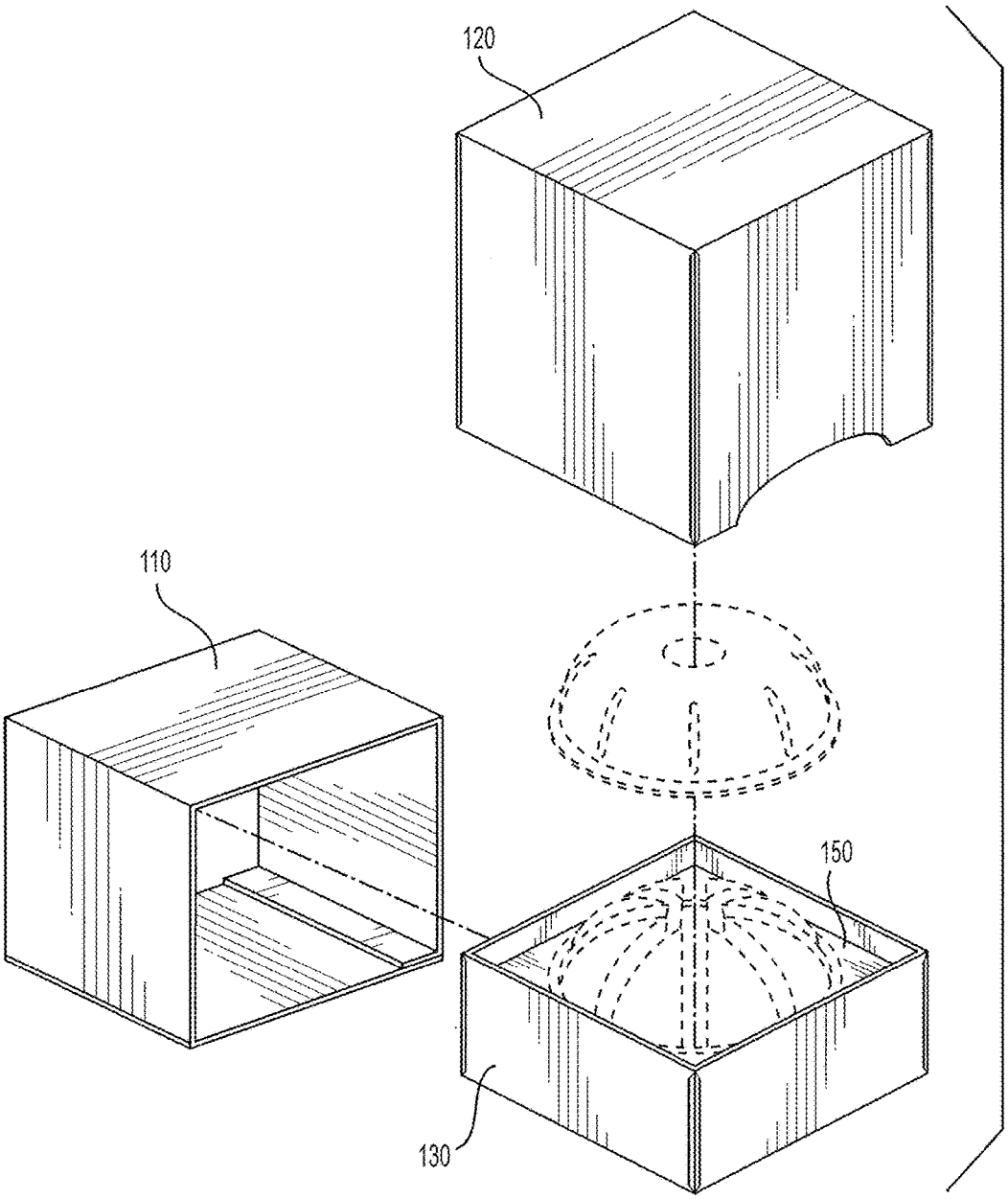
FIG. 1D shows an exemplary embodiment, depicting a semi-exploded view of a packaging system.

In some embodiments, the external package component is an encapsulating set-up carton board box (e.g., top element 120 and bottom element 130 in FIG. 1C). In some embodiments, the packaging disclosed herein further comprises an inner packaging component including a top insert 140 and a bottom insert 150. In some embodiments, the packaging system further comprises an inner compartment for accommodating one or more perishable food items such as fresh cut food dipped in chocolate. In some embodiments, the inner compartment 160 comprises a top piece and a bottom piece; e.g., top lid 170 and bottom tray 180 can snap together to form an enclosed compartment. In some embodiments, the packaging system further comprises an outer sleeve 110.

Top element 120 has an opening at the bottom that fits over bottom element 130 to form an enclosed container. In preferred embodiments, the container is a box. In some embodiments, the container is a ball or has a football shape with an elongated middle portion.

In some embodiments, sleeve 110 can be positioned onto the enclosed container in a direction that will prevent the bottom element from falling out of the top element due to weight of the bottom element itself and of any food piece that is placed inside the enclosed container (e.g., via an inner compartment). In some embodiments, sleeve 110 includes a printed pattern. In some embodiments, sleeve 110 includes a message (e.g., "Happy Birthday" or "Thank You").

The inner packaging component is used to securely hold the inner compartment to prevent any movement of the inner compartment. In some embodiments, the inner packing component includes a top insert 140 and a bottom insert 150. In some embodiments, the top and bottom inserts, each at one end, have an opening in a shape that conforms with the shape of the inner compartment to create a secure fit. For example, as depicted in FIG. 1C, the bottom side of top insert 140 and the top side of bottom insert 150 each has a round opening that securely holds inner compartment 160. However, one of skill in the art would understand that the opening on the top and bottom inserts can have any shape, including but not limited to, for example, circle, square, triangle, rectangle, star shaped, or any other applicable shapes. When inserted into the external packaging component, the openings on the top and bottom inserts face each other and form a continuous space where inner compartment 160 is positioned, snugly between the inserts.

In one aspect, disclosed herein is an inner compartment for securely storing perishable food items. In preferred embodiments, an inner compartment 160 has a top lid 170 and a bottom tray 180 (see, for example, FIGS. 2A-2D). In some embodiments, top lid 170 is a thermoform lid. In some embodiments, bottom tray 180 is a thermoform tray. In some embodiments, top lid 170 is transparent or semi-transparent. In some embodiments, bottom tray 180 is non-transparent and can be made of a suitable colored plastic material.

Figure 2A:
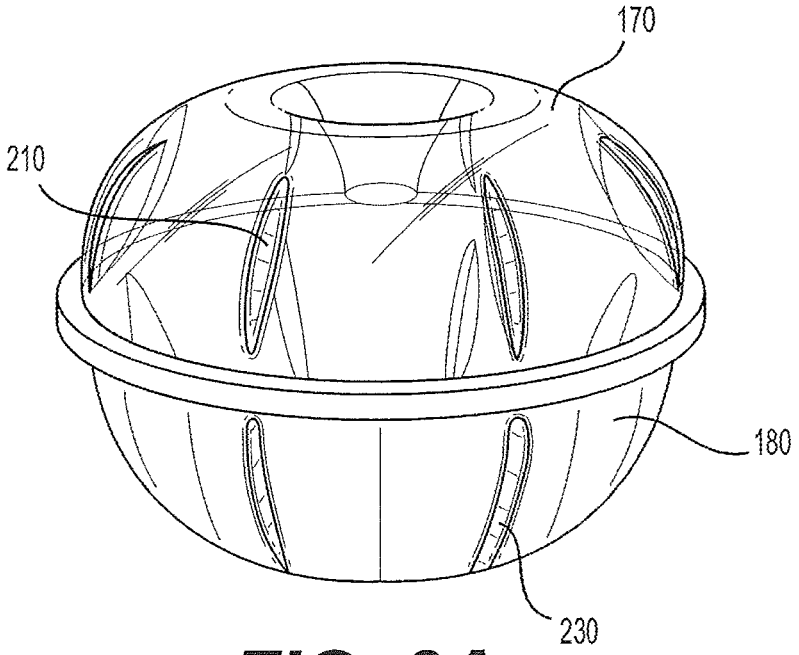
FIG. 2A shows an exemplary embodiment, depicting an enclosed inner compartment.
Figure 2B:
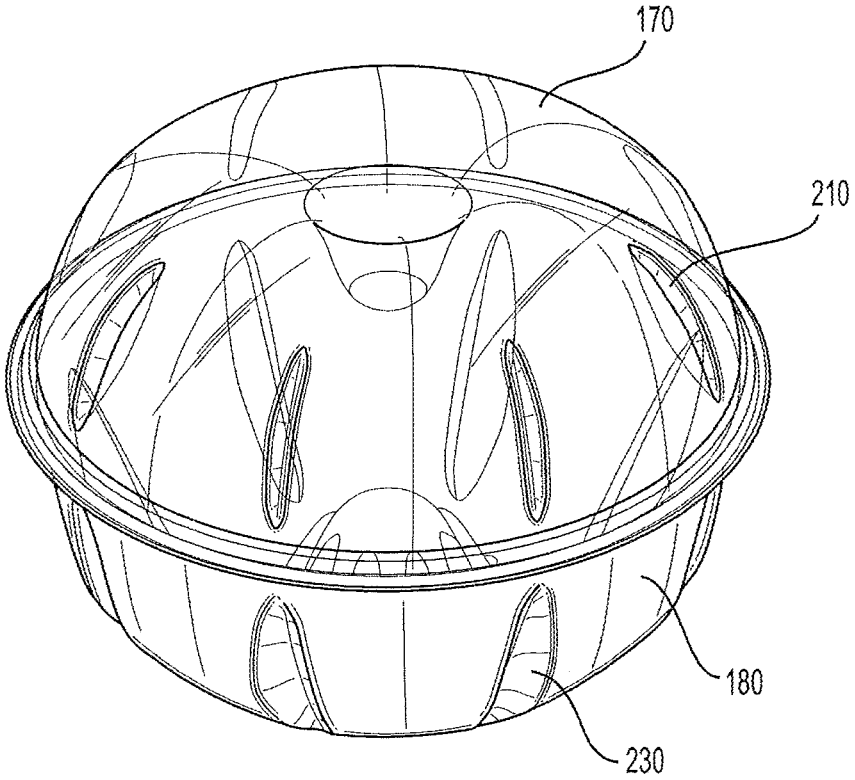
FIG. 2B shows an exemplary embodiment, depicting an enclosed inner compartment.
Figure 2C:
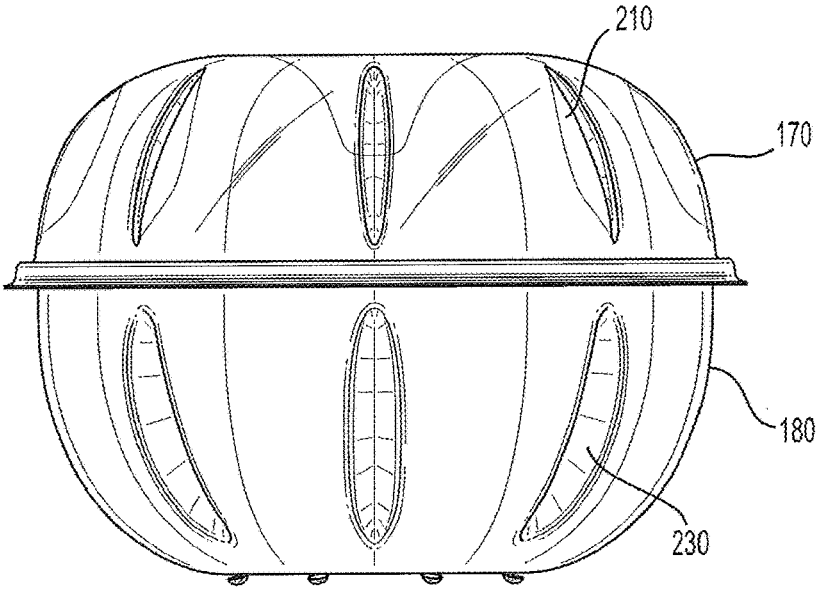
FIG. 2C shows an exemplary embodiment, depicting a side view of an enclosed inner compartment.
Figure 2D:
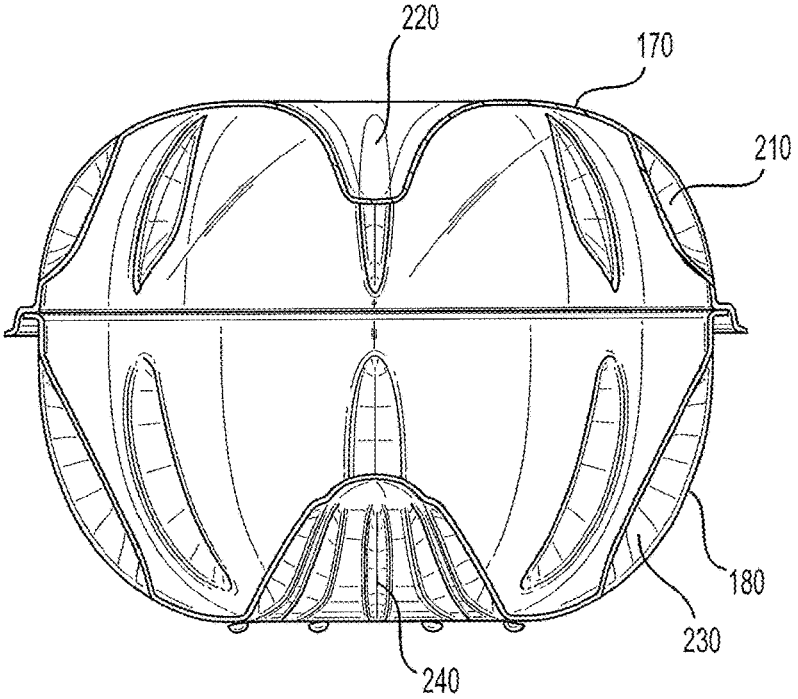
FIG. 2D shows an exemplary embodiment, depicting a cross-sectional view of an enclosed inner compartment.

In some embodiments, top lid and/or bottom tray have one or more types of molded structural elements such as elements 210, 220, 230 and 240 in FIGS. 2A-2D. The molded structural elements help to secure food items when they are placed within the inner compartment. In some embodiments, the structural elements are on the inside of the top lid or bottom tray. The molded structural elements are also aesthetically pleasing. Referring to FIG. 2D, elements 210 are elongated protrusions (or vertical ribs or ridges) that extend from the top of the lid towards the edge or rim of the top lid. Elements 230 are elongated protrusions or vertical ribs that extend from the bottom of the tray towards the edge or rim of the top tray. In some embodiments, the inside of the top lid has a center protrusion 220. In some embodiments, the inside of the bottom tray has a center protrusion 240. Elements 220 and 240 are aligned when the lid and tray are snapped together. These structural elements help to separate individual food items (such as fruit pieces) from each other and help to securely and aesthetically present the food items.

In some embodiments, the bottom tray has a top ridge that is larger than the opening of the bottom insert 160 and the entire bottom tray fits below the opening (see, for example, FIG. 3 and FIG. 4).

In some embodiments, bottom tray 180 includes a plurality of individual molded cavities. Each cavity is configured to hold a food piece. For example, a round shaped cavity holds a chocolate covered banana piece. In some embodiments, the cavity is oval shaped so it securely holds a chocolate covered strawberry. In some embodiments, the cavity is shaped as one end of a sliced apple wedge so it securely holds a chocolate covered apple wedge. In some embodiments, inner compartment 160 includes a molded top and bottom piece that are specifically designed to hold cut pieces of fruit in a ball or 'apple' formation (or that hold other fruit parts in different formations). In embodiments where food items are securely and snugly held in molded cavities in the bottom tray, a top lid with no structural element may be used. In some embodiments, additional security is provided by a top lid that also has structural elements.

In some embodiments, the bottom tray includes individual molded cavities (e.g., FIGS. 3 and 4). In some embodiments, the bottom tray includes 2 individual molded cavities. In some embodiments, the bottom tray includes 3 individual molded cavities. In some embodiments, the bottom tray includes 4 individual molded cavities. In some embodiments, the bottom tray includes 5 individual molded cavities. In some embodiments, the bottom tray includes 6 individual molded cavities. In some embodiments, the bottom tray includes 7 individual molded cavities. In some embodiments, the bottom tray includes 8 individual molded cavities. In some embodiments, the bottom tray includes 10 or fewer individual molded cavities. In some embodiments, the bottom tray includes 12 or fewer individual molded cavities. In some embodiments, the bottom tray includes 15 or fewer individual molded cavities. In some embodiments, the bottom tray includes 15 or more individual molded cavities.

In some embodiments, the top lid and bottom tray have vertical grooves that match the shape of the perishable food items within. For example, the vertical grooves match apple wedges.

In some embodiments, inner packaging elements further comprise a cooling element. Cooling packs or ice packs in accordance with the present invention may have a custom shape in order to properly fit in the package. Custom shapes may include, but are not limited to, circular, spherical, round, ring shaped, and the like. Preferably, the cooling element is a circular structure with an inside circular cavity where a cooling agent is stored (e.g., in a configuration similar to that of a cream-filled doughnut). The cooling element can be pre-frozen. Preferably, the cooling element is placed above top lid 170 within the space between top packaging element 120 and top insert 140. In some embodiments, the cooling element has a dimension that is larger than the dimension of the bottom opening of top insert 140. In some embodiments, the cooling element is placed above top lid 170, between top insert 140 and top lid 170.

Figure 5:
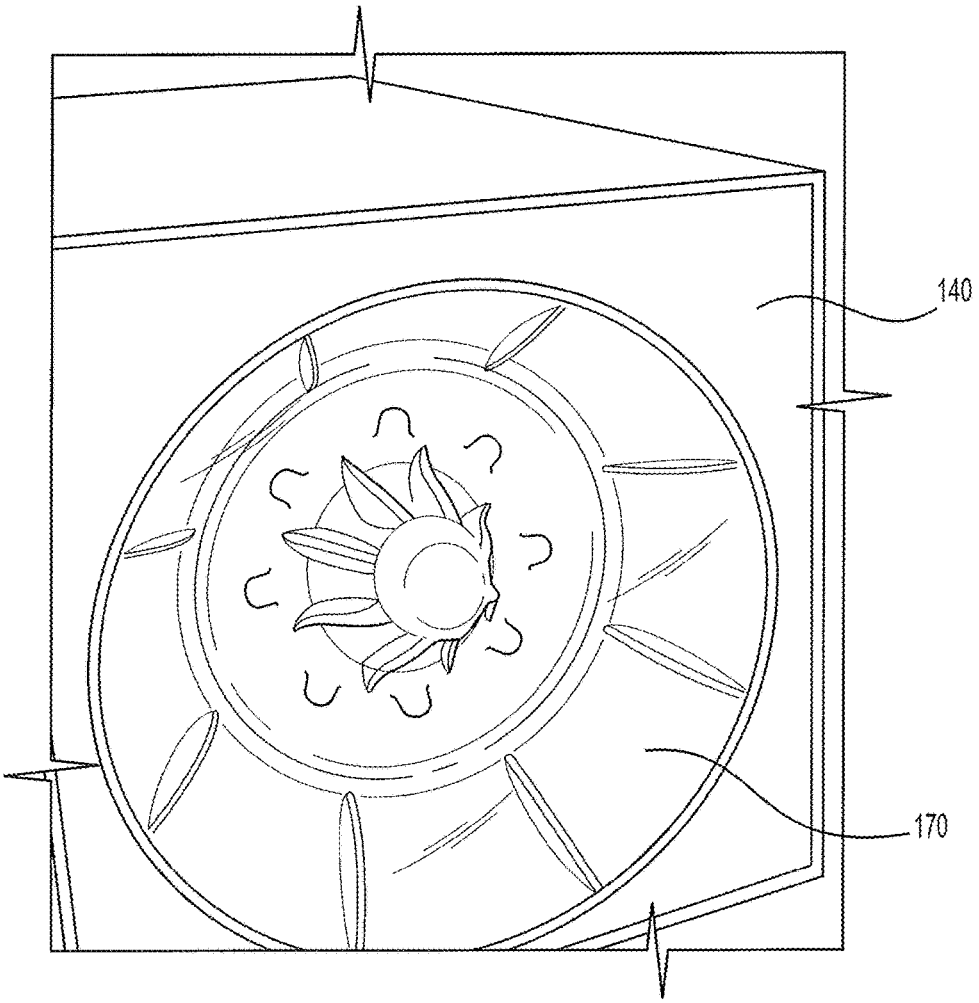
FIG. 5 shows an exemplary embodiment, depicting the inner compartment viewed from the opening of the top packaging insert.

The cooling element is a cooling pack made of plastic or rubber and may be filled with a freezable liquid or gel. Cooling packs can be accommodated in accordance with the example shown in FIG. 5. As shown in FIG. 5, top lid 170 is seen through the bottom opening of top insert 140. A cooling element will be placed on top of element 170 within element 140. The large contact space via the wide opening provides sufficient temperature control within the box.

In some embodiments, the cooling element includes dry ice that is contained in a pack within the inner compartment. In these embodiments, the lid or tray has small holes to avoid air expansion.

In some embodiments, lid 170 and tray 180 are made of water resistant material. The plastic lid and tray are of vacuum form or thermoform construction or injection molded and can be made of various plastic material derivatives, such as but not limited to polyethylene terephlate (PET), EVOH, polypropylene (PP), polystyrene (PS). The plastic formed and used may be clear or colored plastic for mold forming. In some embodiments, the top plastic lid is transparent. In some embodiments, the bottom tray is made of non-transparent plastic material.

In some embodiments, the plastic lid fits over the bottom tray securely but is not a snap fit so that it can be removed without significant effort. Exemplary means for a secure closure includes but is not limited to a snap, plug, screw or a locking type fit.

In some embodiments, the shape of the molded parts can be changed to suit any final product form. However the principle of secure, protected, fruit pieces presented elegantly remains the primary goal of any design. (i.e., blueberry truffles, strawberries, orange coated slices, etc.) For the apple, the lid and bottom tray contain unique wall and center designs to hold the fruit pieces in place in an upright position. Eight (8) vertical ridges or ribs on the lid and bottom tray are used to confine each fruit piece to its location; the center of each plastic piece is a formed hollowed out core to hold fruit pieces in place. This core also contains ridges or ribs to limit fruit movement. More or fewer ridges or ribs on the core or outer wall may be used dependent upon the fruit and slice size. The core designs may also be used to include decorative or promotional inserts.

In one aspect, the bottom tray contains drain features in each section that enables moisture to seep and release below the tray onto an absorbent pad. In some embodiments, the drain features are U-shaped cuts and include a design feature within the cutout area that allows the shape to open and drain while with the weight of the fruit is held above it. Additional drain features include but are not limited to small holes and other types of openings on the bottom tray. In some embodiments, the drain features further include an absorbent pad placed below the bottom tray and within the space inside the bottom packaging insert.

In one aspect, the packaging system further includes a plurality of fruit items securely positioned within the inner compartment. Exemplary fruit items include but are not limited to blueberry truffles, strawberries, orange slices, cut banana pieces, apple wedges, grapes, cut melon pieces, cut pineapple pieces, and combinations thereof. In some embodiments, the fruit items are covered with one or more chocolate coatings (e.g., a white chocolate coating, a dark chocolate coating or combinations thereof).

The method and system disclosed herein offer several advantages: the inner molded parts hold and secure the fruit wedges/slices or other product forms; bottom container offers drainage; the molded parts in both top lid and bottom container are held securely in place by the carton board inserts to securely store the fruit wedges/slices or other products inside.

An exemplary embodiment is seen in FIG. 1, the package may include up to seven (7) components. The outer package is formed box-like by a sleeve that encloses the top and bottom set-up style carton board pieces (designed to be self-assembled quickly by a licensee). These components may be made of carton board material and printed on the interior and exterior. These components can also be constructed of folded rigid plastic material. The printing is decorative and can have special tactile or decorative features, such a soft touch, metalized, embossed, laser or die cut edging or cutouts.

The bottom and top box pieces use inserts, required to hold or cradle the plastic tray pieces in place during set up, delivery, distribution, or presentation. These inserts are flat die cut carton board construction manually folded at scorelines and fit into the top or bottom box piece. These inserts can also be constructed of rigid plastic material. The inserts are decoratively printed on the top and bottom side, and can have special tactile or decorative features, such a soft touch, metalized, embossed, laser or die cut edging or cutouts.

The plastic pieces are set into the carton board inserts to be held secure in place.

Upon receiving the fruit gift, the recipient would discard the plastic top (unless kept to seal or for storage), and display the fruit held in the bottom tray on the inserts and bottom box piece.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

We claim:

1. A package for food items, comprising:

a sleeve; and an external packaging component positioned within the sleeve, the external packaging component comprising:

a top packaging element, and a bottom packaging element, wherein the top packaging element fits over the bottom packaging element to form an enclosed package;

an internal packaging component configured to be in an interior of the enclosed package, comprising:

a top packaging insert including a cooling component positioned thereunder configured to provide temperature control for cooling a plurality of food items stored in an inner compartment, and a bottom packaging insert, wherein the top packaging insert has a bottom opening and the bottom packaging insert has a top opening, and wherein the bottom opening and the top opening face each other and form a continuous space;

the inner compartment securely positioned within the continuous space such that at least a portion of the inner compartment protrudes thru at least one of the bottom opening and the top opening, the inner compartment comprising:

a top cover having an opening configured to receive cool air from the cooling component of the top packaging insert, wherein the cooling component contacts an exterior of the top cover, and a bottom container, wherein the top cover and the bottom container form an enclosed compartment, wherein the top cover includes a first plurality of structural elements positioned along the interior surfaces thereof, the first plurality of structural elements surround a central portion of the top cover, and the bottom container includes a second plurality of structural elements positioned along the interior surfaces thereof, the second plurality of structural elements surround a central portion of the bottom cover, wherein the first plurality of structural elements and the second plurality of structural elements comprise vertically extending, elongated protrusions that protrude into the enclosed compartment, and each of the first plurality of structural elements and each of the second plurality of structural elements are configured to securely store and separate the plurality of food items from each other, wherein each of the plurality of food items are arranged between adjacent structural elements of the first plurality of structural elements, and between adjacent structural elements of the second plurality of structural elements.

2. The package of claim 1, wherein the first plurality of structural elements extend towards an edge of the top cover.

3. The package of claim 1, wherein the second plurality of structural elements extend towards an edge of the bottom container.

4. The package of claim 1, wherein the first plurality of structural elements comprises 6 or more structural elements.

5. The package of claim 1, wherein the first plurality of structural elements comprises 10 or fewer structural elements.

6. The package of claim 1, wherein the second plurality of structural elements comprises 6 or more structural elements.

7. The package of claim 1, wherein the second plurality of structural elements comprises 10 or fewer structural elements.

8. The package of claim 1, wherein the interior surfaces between each of the adjacent structural elements of the first plurality and the second plurality of structural elements is shaped as one end of an apple wedge.

9. The package of claim 1, wherein the cooling element is circular in shape.

10. The package of claim 1, wherein the bottom container of the inner compartment comprises small drainage openings.

11. The package of claim 10, further comprising:

an absorbent pad placed underneath the bottom container.

12. The package of claim 1, wherein the plurality of fruit items are selected from the group consisting of blueberry truffles, strawberries, orange slices, cut banana pieces, apple wedges, grapes, cut melon pieces, cut pineapple pieces, and combinations thereof.

13. The package of claim 12, wherein one or more of the fruit items are covered with chocolate.

14. The package of claim 13, wherein the plurality of fruit items comprises 8 apple wedges covered with dark chocolate.

* * * * *